US008775169B2

(12) United States Patent
Gao

(10) Patent No.: US 8,775,169 B2
(45) Date of Patent: Jul. 8, 2014

(54) ADDING SECOND ENHANCEMENT LAYER TO CELP BASED CORE LAYER

(71) Applicant: Huawei Technologies Co., Ltd., Shenzhen (CN)

(72) Inventor: Yang Gao, Mission Viejo, CA (US)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 13/725,353

(22) Filed: Dec. 21, 2012

(65) Prior Publication Data

US 2013/0110507 A1 May 2, 2013

Related U.S. Application Data

(63) Continuation of application No. 12/559,562, filed on Sep. 15, 2009, now Pat. No. 8,515,742.

(60) Provisional application No. 61/096,905, filed on Sep. 15, 2008.

(51) Int. Cl.
*G10L 19/00* (2013.01)

(52) U.S. Cl.
USPC ..... 704/219

(58) Field of Classification Search
CPC ..... G10L 19/12; G10L 19/24
USPC ..... 704/219, 222, 203, 207, 205, 500
See application file for complete search history.

(56) References Cited

U.S. PATENT DOCUMENTS 5,828,996 A 10/1998 Iijima et al.
5,974,375 A 10/1999 Aoyagi et al.
6,018,706 A 1/2000 Huang et al.
6,507,814 B1 1/2003 Gao
6,629,283 B1 9/2003 Toyama
6,708,145 B1 3/2004 Liljeryd et al.
7,216,074 B2 5/2007 Malah et al.
7,328,160 B2 2/2008 Nishio et al.
7,328,162 B2 2/2008 Liljeryd et al.

(Continued)

FOREIGN PATENT DOCUMENTS

WO WO 2007/087824 A1 8/2007

OTHER PUBLICATIONS

"G.729-based embedded variable bit-rate coder: An 8-32 kbits/s scalable wideband coder bitstream interoperable with G.729," Series G: Transmission Systems and Media, Digital Systems and Networks, Digital Terminal equipments—Coding of analogue signals by methods other than PCM, International Telecommunication Union, ITU-T Recommendation G.729. May 1, 2006, 100 pages.

(Continued)

*Primary Examiner* — Jakieda Jackson

(74) *Attorney, Agent, or Firm* — Slater & Matsil, L.L.P.

(57) ABSTRACT

In an embodiment, a method of transmitting an input audio signal is disclosed. A first coding error of the input audio signal with a scalable codec having a first enhancement layer is encoded, and a second coding error is encoded using a second enhancement layer after the first enhancement layer. Encoding the second coding error includes coding fine spectrum coefficients of the second coding error to produce coded fine spectrum coefficients, and coding a spectral envelope of the second coding error to produce a coded spectral envelope. The coded fine spectrum coefficients and the coded spectral envelope are transmitted.

22 Claims, 6 Drawing Sheets

(56) References Cited

U.S. PATENT DOCUMENTS

| | | | | |
|---|---|---|---|---|
| 7,359,854 | B2 | 4/2008 | Nilsson et al. | |
| 7,433,817 | B2 | 10/2008 | Kjorling et al. | |
| 7,447,631 | B2 | 11/2008 | Truman et al. | |
| 7,469,206 | B2 | 12/2008 | Kjorling et al. | |
| 7,546,237 | B2 | 6/2009 | Nongpiur et al. | |
| 7,627,469 | B2 | 12/2009 | Nettre et al. | |
| 7,752,038 | B2 | 7/2010 | Laaksonen et al. | |
| 8,150,684 | B2 * | 4/2012 | Kawashima et al. | 704/219 |
| 2002/0002456 | A1 | 1/2002 | Vainio et al. | |
| 2002/0107686 | A1 * | 8/2002 | Unno | 704/219 |
| 2003/0093278 | A1 | 5/2003 | Malah | |
| 2003/0200092 | A1 | 10/2003 | Gao et al. | |
| 2004/0015349 | A1 | 1/2004 | Vinton et al. | |
| 2004/0181397 | A1 | 9/2004 | Gao | |
| 2004/0225505 | A1 | 11/2004 | Andersen et al. | |
| 2005/0010404 | A1 * | 1/2005 | Son et al. | 704/219 |
| 2005/0159941 | A1 | 7/2005 | Kolesnik et al. | |
| 2005/0165603 | A1 | 7/2005 | Bessette et al. | |
| 2005/0278174 | A1 | 12/2005 | Sasaki et al. | |
| 2006/0036432 | A1 | 2/2006 | Kjorling et al. | |
| 2006/0147124 | A1 | 7/2006 | Edler et al. | |
| 2006/0271356 | A1 | 11/2006 | Vos | |
| 2007/0088558 | A1 | 4/2007 | Vos et al. | |
| 2007/0208557 | A1 * | 9/2007 | Li et al. | 704/200.1 |
| 2007/0255559 | A1 | 11/2007 | Gao et al. | |
| 2007/0276655 | A1 * | 11/2007 | Lee et al. | 704/200 |
| 2007/0282603 | A1 | 12/2007 | Bessette | |
| 2007/0299662 | A1 | 12/2007 | Kim et al. | |
| 2007/0299669 | A1 | 12/2007 | Ehara | |
| 2008/0010062 | A1 | 1/2008 | Son et al. | |
| 2008/0027711 | A1 | 1/2008 | Rajendran et al. | |
| 2008/0052066 | A1 * | 2/2008 | Oshikiri et al. | 704/221 |
| 2008/0052068 | A1 | 2/2008 | Aguilar et al. | |
| 2008/0091418 | A1 | 4/2008 | Laaksonen et al. | |
| 2008/0120117 | A1 | 5/2008 | Choo et al. | |
| 2008/0126081 | A1 | 5/2008 | Geiser et al. | |
| 2008/0126086 | A1 | 5/2008 | Vos et al. | |
| 2008/0154588 | A1 | 6/2008 | Gao | |
| 2008/0195383 | A1 | 8/2008 | Shlomot et al. | |
| 2008/0208572 | A1 | 8/2008 | Nongpiur et al. | |
| 2008/0249766 | A1 * | 10/2008 | Ehara | 704/203 |
| 2009/0024399 | A1 | 1/2009 | Gartner et al. | |
| 2009/0125301 | A1 | 5/2009 | Master et al. | |
| 2009/0240491 | A1 * | 9/2009 | Reznik | 704/219 |
| 2009/0254783 | A1 | 10/2009 | Hirschfeld et al. | |
| 2010/0063802 | A1 | 3/2010 | Gao | |
| 2010/0063803 | A1 | 3/2010 | Gao | |
| 2010/0063810 | A1 | 3/2010 | Gao | |
| 2010/0063827 | A1 | 3/2010 | Gao | |
| 2010/0070269 | A1 | 3/2010 | Gao | |
| 2010/0070270 | A1 | 3/2010 | Gao | |
| 2010/0121646 | A1 | 5/2010 | Ragot et al. | |
| 2010/0211384 | A1 | 8/2010 | Qi et al. | |
| 2010/0292993 | A1 | 11/2010 | Vaillancourt et al. | |

OTHER PUBLICATIONS

International Search Report and Written Opinion, International Application No. PCT/US2009/056106, Huawei Technologies Co., Ltd., Date of Mailing Oct. 19, 2009, 11 pages.

International Search Report and Written Opinion, International Application No. PCT/US2009/056111, GH Innovation, Inc. Date of Mailing Oct. 23, 2009, 13 pages.

International Search Report and Written Opinion, International Application No. PCT/US2009/056113, Huawei Technologies Co., Ltd., Date of Mailing Oct. 22, 2009, 10 pages.

International Search Report and Written Opinion, International Application No. PCT/US2009/056117, GH Innovation, Inc., Date of Mailing Oct. 19 (22), 2009, 10 pages.

International Search Report and Written Opinion, International Application No. PCT/US2009/56981, GH Innovation, Inc., Date of Mailing Nov. 2, 2009, 11 pages.

International Search Report and Written Opinion, International Application No. PCT/US2009/056860, Huawei Technologies Co., Ltd., Date of mailing Oct. 26, 2009, 11 pages.

* cited by examiner

ADDING SECOND ENHANCEMENT LAYER TO CELP BASED CORE LAYER

CROSS REFERENCE TO RELATED APPLICATIONS

This patent application is a continuation of U.S. patent application Ser. No. 12/559,562 filed on Sep. 15, 2009 which claims priority to U.S. Provisional Application No. 61/096,905 filed on Sep. 15, 2008, entitled "Selectively Adding Second Enhancement Layer to CELP Based Core Layer," which application is hereby incorporated by reference herein in its entirety.

TECHNICAL FIELD

This invention is generally in the field of speech/audio coding, and more particularly related to scalable speech/audio coding.

BACKGROUND

Coded-Excited Linear Prediction (CELP) is a very popular technology which is used to encode a speech signal by using specific human voice characteristics or a human vocal voice production model. Examples of CELP inner core layer plus a first Modified Discrete Cosine Transform (MDCT) enhancement layer can be found in the ITU-T G.729.1 or G.718 standards, the related contents of which are summarized hereinbelow. A very detailed description can be found in the ITU-T standard documents.

General Description of ITU-T G.729.1

ITU-T G.729.1 is also called a G.729EV coder which is an 8-32 kbit/s scalable wideband (50-7000 Hz) extension of ITU-T Rec. G.729. By default, the encoder input and decoder output are sampled at 16,000 Hz. The bitstream produced by the encoder is scalable and has 12 embedded layers, which will be referred to as Layers 1 to 12. Layer 1 is the core layer corresponding to a bit rate of 8 kbit/s. This layer is compliant with the G.729 bitstream, which makes G.729EV interoperable with G.729. Layer 2 is a narrowband enhancement layer adding 4 kbit/s, while Layers 3 to 12 are wideband enhancement layers adding 20 kbit/s with steps of 2 kbit/s.

This coder is designed to operate with a digital signal sampled at 16,000 Hz followed by conversion to 16-bit linear pulse code modulation (PCM) for the input to the encoder. However, the 8,000 Hz input sampling frequency is also supported. Similarly, the format of the decoder output is 16-bit linear PCM with a sampling frequency of 8,000 or 16,000 Hz. Other input/output characteristics are converted to 16-bit linear PCM with 8,000 or 16,000 Hz sampling before encoding, or from 16-bit linear PCM to the appropriate format after decoding.

The G.729EV coder is built upon a three-stage structure: embedded Code-Excited Linear-Prediction (CELP) coding, Time-Domain Bandwidth Extension (TDBWE) and predictive transform coding that will be referred to as Time-Domain Aliasing Cancellation (TDAC). The embedded CELP stage generates Layers 1 and 2, which yield a narrowband synthesis (50-4,000 Hz) at 8 kbit/s and 12 kbit/s. The TDBWE stage generates Layer 3 and allows producing a wideband output (50-7000 Hz) at 14 kbit/s. The TDAC stage operates in the MDCT domain and generates Layers 4 to 12 to improve quality from 14 to 32 kbit/s. TDAC coding represents jointly the weighted CELP coding error signal in the 50-4,000 Hz band and the input signal in the 4,000-7,000 Hz band.

The G.729EV coder operates on 20 ms frames. However, the embedded CELP coding stage operates on 10 ms frames, like G.729. As a result, two 10 ms CELP frames are processed per 20 ms frame. In the following, to be consistent with the text of ITU-T Rec. G.729, the 20 ms frames used by G.729EV will be referred to as superframes, whereas the 10 ms frames the 5 ms subframes involved in the CELP processing will be respectively called frames and subframes.

G729.1 Encoder

A functional diagram of the G729.1 encoder part is presented in FIG. 1. The encoder operates on 20 ms input superframes. By default, input signal 101, $s_{WB}(n)$, is sampled at 16,000 Hz., therefore, the input superframes are 320 samples long. Input signal $s_{WB}(n)$ is first split into two sub-bands using a quadrature mirror filterbank (QMF) defined by the filters $H_1(z)$ and $H_2(z)$. Lower-band input signal 102, $s_{LB}^{qmf}(n)$, obtained after decimation is pre-processed by a high-pass filter $H_{h1}(z)$ with 50 Hz cut-off frequency. The resulting signal 103, $s_{LB}(n)$, is coded by the 8-12 kbit/s narrowband embedded CELP encoder. To be consistent with ITU-T Rec. G.729, the signal $s_{LB}(n)$ will also be denoted s(n). The difference 104, $d_{LB}(n)$, between s(n) and the local synthesis 105, $\hat{s}_{enh}(n)$, of the CELP encoder at 12 kbit/s is processed by the perceptual weighting filter $W_{LB}(z)$. The parameters of $W_{LB}(z)$ are derived from the quantized LP coefficients of the CELP encoder. Furthermore, the filter $W_{LB}(z)$ includes a gain compensation that guarantees the spectral continuity between the output 106, $d_{LB}^{w}(n)$, of $W_{LB}(z)$ and the higher-band input signal 107, $s_{HB}(n)$. The weighted difference $d_{LB}^{w}(n)$ is then transformed into frequency domain by MDCT. The higher-band input signal 108, $s_{HB}^{fold}(n)$, obtained after decimation and spectral folding by $(-1)^n$ is pre-processed by a low-pass filter $H_{h2}(z)$ with a 3,000 Hz cut-off frequency. Resulting signal $s_{HB}(n)$ is coded by the TDBWE encoder. The signal $s_{HB}(n)$ is also transformed into the frequency domain by MDCT. The two sets of MDCT coefficients, 109, $D_{LB}^{w}(k)$, and 110, $S_{HB}(k)$, are finally coded by the TDAC encoder. In addition, some parameters are transmitted by the frame erasure concealment (FEC) encoder in order to introduce parameter-level redundancy in the bitstream. This redundancy allows improved quality in the presence of erased superframes.

G729.1 Decoder

A functional diagram of the G729.1 decoder is presented in FIG. 2*a*, however, the specific case of frame erasure concealment is not considered in this figure. The decoding depends on the actual number of received layers or equivalently on the received bit rate.

If the received bit rate is:

8 kbit/s (Layer 1): The core layer is decoded by the embedded CELP decoder to obtain 201, $\hat{s}_{LB}(n)=\hat{s}(n)$. Then, $\hat{s}_{LB}(n)$ is postfiltered into 202, $\hat{s}_{LB}^{post}(n)$, and post-processed by a high-pass filter (HPF) into 203, $\hat{s}_{LB}^{qmf}(n)=\hat{s}_{LB}^{hpf}(n)$. The QMF synthesis filterbank defined by the filters $G_1(z)$ and $G_2(z)$ generates the output with a high-frequency synthesis 204, $\hat{s}_{HB}^{qmf}(n)$, set to zero.

12 kbit/s (Layers 1 and 2): The core layer and narrowband enhancement layer are decoded by the embedded CELP decoder to obtain 201, $\hat{s}_{LB}(n)=\hat{s}_{enh}(n)$, and $\hat{s}_{LB}(n)$ is then postfiltered into 202, $\hat{s}_{LB}^{post}(n)$ and high-pass filtered to obtain 203, $\hat{s}_{LB}^{qmf}(n)=\hat{s}_{LB}^{hpf}(n)$. The QMF synthesis filterbank generates the output with a high-frequency synthesis 204, $\hat{s}_{HB}^{qmf}(n)$ set to zero.

14 kbit/s (Layers 1 to 3): In addition to the narrowband CELP decoding and lower-band adaptive postfiltering, the TDBWE decoder produces a high-frequency synthesis 205, $\hat{s}_{HB}^{bwe}(n)$ which is then transformed into frequency domain by MDCT so as to zero the frequency band above 3000 Hz in the higher-band spectrum 206, $\hat{S}_{HB}^{bwe}(n)$. The resulting spectrum 207, $\hat{S}_{HB}(k)$ is transformed in time domain by inverse MDCT and overlap-add before spectral folding by $(-1)^n$. In the QMF synthesis filterbank the reconstructed higher band signal 204, $\hat{s}_{HB}^{qmf}(n)$ is combined with the respective lower band signal 202, $\hat{s}_{LB}^{qmf}(n)=\hat{s}_{LB}^{post}(n)$ reconstructed at 12 kbit/s without high-pass filtering.

Above 14 kbit/s (Layers 1 to 4+): In addition to the narrowband CELP and TDBWE decoding, the TDAC decoder reconstructs MDCT coefficients 208, $\hat{D}_{LB}^{w}(k)$ and 207, $\hat{S}_{HB}(k)$, which correspond to the reconstructed weighted difference in lower band (0-4,000 Hz) and the reconstructed signal in higher band (4,000-7,000 Hz). Note that in the higher band, the non-received sub-bands and the sub-bands with zero bit allocation in TDAC decoding are replaced by the level-adjusted sub-bands of $\hat{S}_{HB}^{bwe}(k)$. Both $\hat{D}_{LB}^{w}(k)$ and $\hat{S}_{HB}(k)$ are transformed into the time domain by inverse MDCT and overlap-add. Lower-band signal 209, $\hat{d}_{LB}^{w}(n)$ is then processed by the inverse perceptual weighting filter $W_{LB}(z)^{-1}$. To attenuate transform coding artifacts, pre/post-echoes are detected and reduced in both the lower- and higher-band signals 210, $\hat{d}_{LB}(n)$ and 211, $\hat{s}_{HB}(n)$. The lower-band synthesis $\hat{s}_{LB}(n)$ is postfiltered, while the higher-band synthesis 212, $\hat{s}_{HB}^{fold}(n)$, is spectrally folded by $(-1)^n$. The signals $\hat{s}_{LB}^{qmf}(n)=\hat{s}_{LB}^{post}(n)$ and $\hat{s}_{HB}^{qmf}(n)$ are then combined and upsampled in the QMF synthesis filterbank.

Bit Allocation to Coder Parameters and Bitstream Layer Format

For a given bit rate, the bitstream is obtained by concatenation of the contributing layers. For example, at 24 kbit/s, which corresponds to 480 bits per superframe, the bitstream comprises Layer 1(160 bits)+Layer 2(80 bits)+Layer 3(40 bits)+Layers 4 to 8(200 bits). The G.729EV bitstream format is illustrated in FIG. 2*b*.

Since the TDAC coder employs spectral envelope entropy coding and adaptive sub-band bit allocation, the TDAC parameters are encoded with a variable number of bits. However, the bitstream above 14 kbit/s can be still formatted into layers of 2 kbit/s, because the TDAC encoder performs a bit allocation on the basis of the maximum encoder bitrate (32 kbit/s) and the TDAC decoder can handle bitstream truncations at arbitrary positions.

G.729.1 TDAC Encoder (Layers 4 to 12)

A G.729.1 Time Domain Aliasing Cancellation (TDAC) encoder is illustrated in FIG. 3. The TDAC encoder represents jointly two split MDCT spectra 301, $D_{LB}^{w}(k)$, and 302, $S_{HB}(k)$, by gain-shape vector quantization. $D_{LB}^{w}(k)$ represents CELP coding error in weighted spectrum domain of [0.4 kHz] and $S_{HB}(k)$ is the unquantized weighted spectrum of [4 kHz, 8 kHz]. The joint spectrum is divided into sub-bands. The gains in each sub-band define the spectral envelope and the shape of each sub-band is encoded by embedded spherical vector quantization using trained permutation codes.

G.729.1 Perceptual Weighting of the CELP Difference Signal

The difference 104, $d_{LB}(n)$, between the embedded CELP encoder input s(n) and the 12 kbit/s local synthesis 105, $\hat{s}_{enh}(n)$, is processed by a perceptual weighting filter $W_{LB}(z)$ defined as:

$$W_{LB}(z) = fac\frac{\hat{A}(z/\gamma_1')}{\hat{A}(z/\gamma_2')}, \tag{1}$$

where fac is a gain compensation and $\hat{a}_i$ are the coefficients of the quantized linear-prediction filter $\hat{A}(z)_i$ obtained from the embedded CELP encoder. The gain compensation factor guarantees the spectral continuity between the output 106, $d_{LB}^{w}(n)$, of $W_{LB}(z)$ and the signal 107, $s_{HB}(n)$, in the adjacent higher band. The filter $W_{LB}(z)$ models the short-term inverse frequency masking curve and allows applying MDCT coding optimized for the mean-square error criterion. It also maps the difference signal 104, $d_{LB}(n)$, into a weighted domain similar to the CELP target domain used at 8 and 12 kbit/s.

Sub-Bands

The MDCT coefficients in the 0-7,000 Hz band are split into 18 sub-bands. The j-th sub-band comprises nb_coef(j) coefficients 103, Y(k), with sb_bound (j)≤k≤sb_bound (j+1). The first 17 sub-bands comprise 16 coefficients (400 Hz), and the last sub-band comprises 8 coefficients (200 Hz). The spectral envelope is defined as the root mean square (rms) 304 in log domain of the 18 sub-bands:

$$\text{log_rms}(j) = \frac{1}{2}\log_2\left[\frac{1}{\text{nb_coef}(j)}\sum_{k=sb_bound(j)}^{sb_bound(j+1)-1} Y(k)^2 + \varepsilon_{rms}\right], \quad j = 0, \ldots, 17, \tag{2}$$

where: $\epsilon_{rms}=2^{-24}$. The spectral envelope is quantized with 5 bits by uniform scalar quantization and the resulting quantization indices are coded using a two-mode binary encoder. The 5-bit quantization consists in computing the indices 305, rms_index(j), j=0, . . . , 17, as follows:

$$\text{rms_index}(j) = \text{round}\left(\frac{1}{2}\text{log_rms}(j)\right), \tag{3}$$

with the restriction:

$$-11 \le \text{rms_index}(j) \le +20, \tag{4}$$

i.e., the indices are limited by −11 and +20(32 possible values). The resulting quantized full-band envelope is then divided into two subvectors:

lower-band spectral envelope: (rms_index(0), rms_index (1), . . . , rms_index(9)); and higher-band spectral envelope: (rms_index(10), rms_index(11), . . . , rms_index(17)).

These two subvectors are coded separately using a two-mode lossless encoder which switches adaptively between differential Huffman coding (mode 0) and direct natural binary coding (mode 1). Differential Huffman coding is used to minimize the average number of bits, whereas direct natural binary coding is used to limit the worst-case number of bits as well to correctly encode the envelope of signals which are saturated by differential Huffman coding (e.g., sinusoids). One bit is used to indicate the selected mode to the spectral envelope decoder. The higher-band spectral envelope is encoded in a similar way, i.e., by switched differential Huffman coding and (direct) natural binary coding. One bit is used to indicate the selected mode to the decoder.

Sub-Band Ordering by Perceptual Importance

The perceptual importance 307, ip(j), j=0 . . . 17, of each sub-band is defined as:

$$ip(j) = \frac{1}{2}\log_2(\text{rms_q}(j)^2 \times \text{nb_coef}(j)) + \text{offset}, \quad (5)$$

where $\text{rms_q}(j)=2^{1/2\ rms_index(j)}$ is the quantized rms and $\text{rms_q}(j)^2\times\text{nb_coef}(j)$ corresponds to the quantized sub-band energy. Consequently, the perceptual importance is equivalent to the sub-band log-energy (let alone the offset). This information is related to the quantized spectral envelope as follows:

$$ip(j) = \frac{1}{2}[\text{rms_index}(j) + \log_2(\text{nb_coef}(j))] + \text{offset}. \quad (6)$$

The offset value is introduced to simplify further the expression of 307, ip(j). Using offset=−2, the perceptual importance boils down to:

$$ip(j) = \begin{cases} \frac{1}{2}\text{rms_index}(j) & \text{for } j = 0, \ldots, 16 \\ \frac{1}{2}(\text{rms_index}(j) - 1) & \text{for } j = 17. \end{cases} \quad (7)$$

The sub-bands are then sorted by decreasing perceptual importance. The result is an index $0\leq\text{ord_ip}(j)<18$, j=0, . . . , 17 for each sub-band which indicates that sub-band j has the (ord_ip(j)+1)-th largest perceptual importance. This ordering is used for bit allocation and multiplexing of vector quantization indices.

Bit Allocation for Split Spherical Vector Quantization

The number of bits allocated to each sub-band is determined using the perceptual importance ip(j), j=0 . . . 17, which is also computed at the TDAC decoder. As a result, the decoder can perform the same operation without any side information. The maximum allocation is limited to 2 bits per sample. The total bit budget is nbits_VQ=351-nbits_HB-nbits_LB, where nbits_LB and nbits_HB correspond to the number of bits used to encode the lower-band and higher-band spectral envelope, respectively. The total number of allocated bits never exceeds the bit budget (due to the properly initialized search interval). However it may be inferior to the bit budget. In this case the remaining bit budget is further distributed to each sub-band in the order of decreasing perceptual importance (this procedure is based on the indices ord_ip(j)).

Quantization of MDCT Coefficients

Each sub-band j=0, . . . , 17 of dimension nb_coef(j) is encoded with nbit(j) bits by spherical vector quantization. This operation is divided into two steps: (1) searching for the best codevector and (2) indexing of the selected codevector.

TDAC Decoder (Layers 4 to 12)

The TDAC decoder is depicted in FIG. 4. The received normalization factor (called norm_MDCT) transmitted by the encoder with 4 bits is used in the TDAC decoder to scale the MDCT coefficients. The factor is used to scale the signal reconstructed by two inverse MDCTs.

Spectral Envelope Decoding

The higher-band spectral envelope is decoded first. The bit indicating the selected coding mode at the encoder may be: 0→differential Huffman coding, 1→natural binary coding. If mode 0 is selected, 5 bits are decoded to obtain an index rms_index(10) in [−11, +20]. Then, the Huffman codes associated with the differential indices diff_index(j), j=11, . . . , 17, are decoded. The index, 401, rms_index(j), j=11, . . . , 17, is reconstructed as follows:

$$\text{rms_index}(j)=\text{rms_index}(j-1)+\text{diff_index}(j). \quad (8)$$

If mode 1 is selected, rms_index(j), j=10, . . . , 17, is obtained in [−11, +20] by decoding 8×5 bits. If the number of bits is not sufficient to decode the higher-band spectral envelope completely, the decoded indices rms_index(j) are kept to allow partial level-adjustment of the decoded higher-band spectrum. The bits related to the lower band, i.e., rms_index (j), j=0, . . . , 9, are decoded in a similar way as in the higher band, including one bit to select mode 0 or 1. The decoded indices are combined into a single vector [rms_index(0) rms_index(1) . . . rms_index(17)], which represents the reconstructed spectral envelope in log domain. This envelope is converted into the linear domain as follows, 402:

$$\text{rms_}q(j)=2^{1/2\ rms_index(j)} \quad (9)$$

If the spectral envelope is not completely decoded, the sub-band ordering is not performed, and the bit allocation is not performed.

Decoding of the Vector Quantization Indices

The vector quantization indices are read from the TDAC bitstream according to their perceptual importance. If sub-band j has zero bit allocated, i.e., 403, nbit(j)=0, or if the corresponding vector quantization is not received, its coefficients are set to zero at this stage. In sub-band j of dimension nb_coef(j) and non-zero bit allocation, 403, nbit(j), the vector quantization index identifies a codevector y which is a signed permutation of an absolute leader $y_0$.

Extrapolation of Missing Higher-Band Sub-Bands and Level Adjustment of Extrapolated Sub-Bands In the higher-band spectrum (for sub-bands j=10, . . . , 17) the non-received sub-bands and the sub-bands with nbit(j)=0 are replaced by the equivalent sub-bands in the MDCT of the TDBWE synthesis, i.e., 406, $\hat{Y}^{ext}(\text{sb_bound}(j)+k)=\hat{S}_{HB}^{bwe}(\text{sb_bound}(j)-160+k)$, k=0, . . . , nb_coef(j)−1. To gracefully improve quality with the number of received TDAC layers, the MDCT coefficients of the signal, 405, $\hat{s}_{HB}^{bwe}(n)$ obtained by bandwidth extension (TDBWE) are level adjusted based on the received TDAC spectral envelope. The rms of the extrapolated sub-bands is therefore set to, 402, rms_q(j) if this higher-band envelope information is available.

Inverse Perceptual Weighting Filter

The inverse filter $W_{LB}(Z)^{-1}$ is defined as:

$$W_{LB}(z)^{-1} = \frac{1}{fac}\frac{\hat{A}(z/\gamma_2')}{\hat{A}(z/\gamma_1')}, \quad (10)$$

where 1/fac is a gain compensation factor and $\hat{a}_i$ are the coefficients of the decoded linear-predictive filter $\hat{A}(z)$ obtained from the narrowband embedded CELP decoder as in 4.1.1/G.729. As in the encoder, these coefficients are updated every 5 ms subframe. The role of $W_{LB}(z)^{-1}$ is to shape the coding noise introduced by the TDAC decoder in the lower band. The factor 1/fac is adapted to guarantee the spectral continuity between $\hat{d}_{LB}(n)$ and $\hat{s}_{LB}(n)$.

SUMMARY OF THE INVENTION

One embodiment provides method of improving a scalable codec when a CELP codec is the inner core layer. The scalable codec has a first MDCT enhancement layer to code a first coding error. An independent second MDCT enhancement layer is introduced to further code a second coding error after said first MDCT enhancement layer. The independent second MDCT enhancement layer not only adds a new coding of said fine spectrum coefficients of the second coding error, but also provides new spectral envelope coding of the second coding error.

In one example, the first coding error represents a distortion of the decoded CELP output. The first coding error is the weighted difference between an original reference input and a CELP decoded output.

In one example, missing subbands of the first MDCT enhancement layer, which are not coded in the core codec, are first compensated or coded at high scalable layers.

In one example, in frequency domain, the second coding error is:

$$DD_{LB}^{w}(k)=D_{LB}^{w}(k)-\hat{D}_{LB}^{w}(k)$$

where $\hat{D}_{LB}^{w}(k)$ is said quantized output of said first MDCT enhancement layer in weighted domain, and $D_{LB}^{w}(k)$ is the unquantized MDCT coefficients of said first coding error.

In one example, the new spectral envelope coding of said second coding error comprises coding spectral subband energies of the second coding error in Log domain, Linear domain or weighted domain.

In one example, the new coding of said fine spectrum coefficients of said second coding error comprises any kind of additional spectral VQ coding of the second coding error with its energy normalized by using the new spectral envelope coding.

Another embodiment provides method of improving a scalable codec when a CELP codec is the inner core layer. The scalable codec has a first MDCT enhancement layer to code said first coding error. The method further introduces an independent second MDCT enhancement layer to further code a second coding error after the first MDCT enhancement layer. The independent second MDCT enhancement layer is selectively added according to a detection of needing the independent second MDCT enhancement layer.

In one example the detection of needing the independent second MDCT enhancement layer includes the parameter(s) of representing relative energies in different spectral subband(s) of said first coding error and/or said second coding error in Log domain, Linear domain, weighted domain or perceptual domain.

In one embodiment, the detection of needing the independent second MDCT enhancement layer includes checking if the transmitted pitch lag is different from the real pitch lag while the real pitch lag is out of the range limitations defined in the CELP codec, as explained in the description.

In one embodiment, the detection of needing the independent second MDCT enhancement layer includes the parameter of pitch gain, the parameter of pitch correlation, the parameter of voicing ratio representing signal periodicity, the parameter of spectral sharpness measuring based on the ratio between the average energy level and the maximum energy level, the parameter of spectral tilt measuring in time domain or frequency domain, and/or the parameter of spectral envelope stability measured on relative spectrum energy differences over time, as explained in the description.

The foregoing has outlined, rather broadly, features of the present invention. Additional features of the invention will be described, hereinafter, which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

Figure 1:
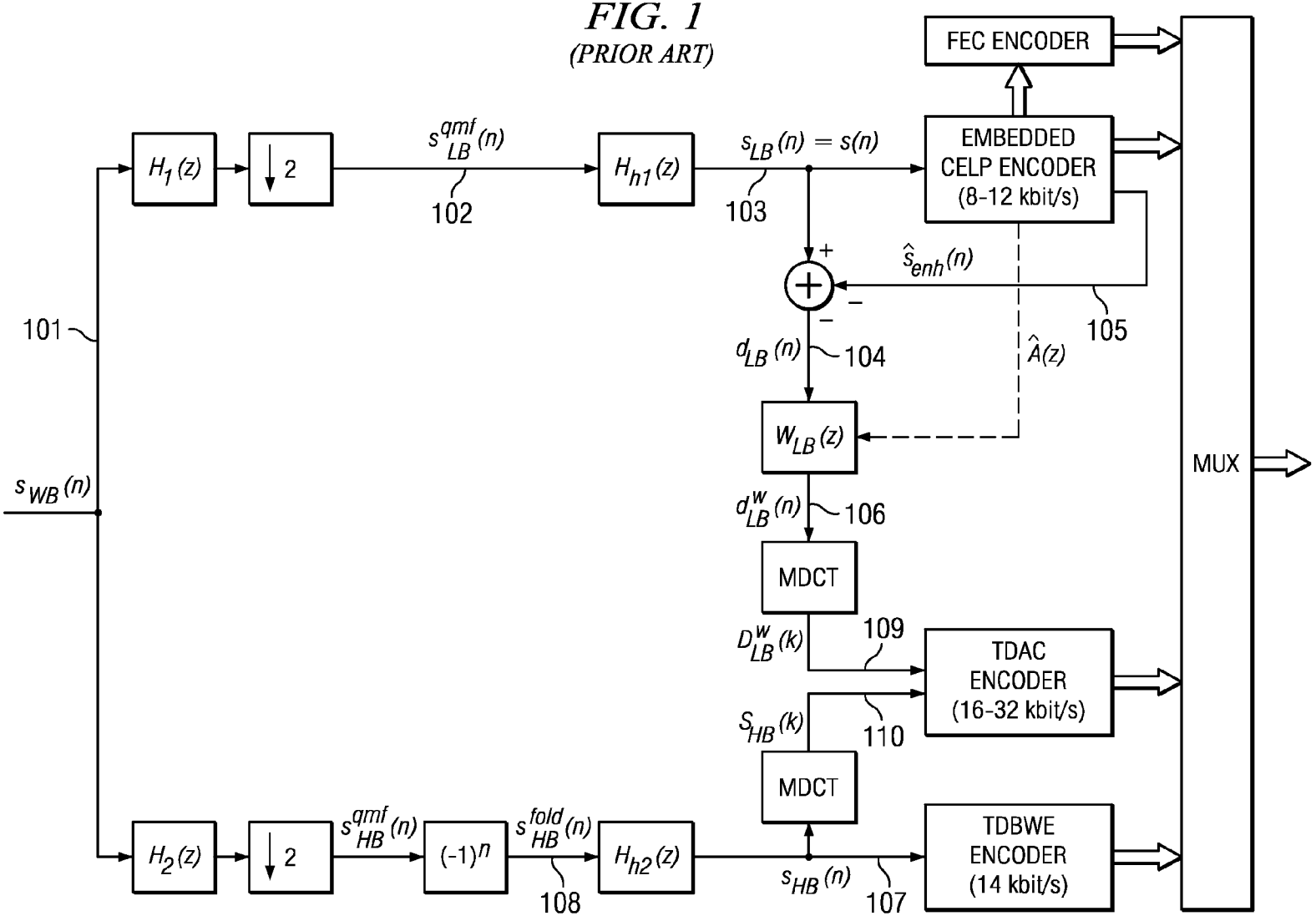
FIG. 1 (PRIOR ART)
FIG. 1 illustrates high-level block diagram of a prior-art ITU-T G.729.1 encoder.
Figure 2A:
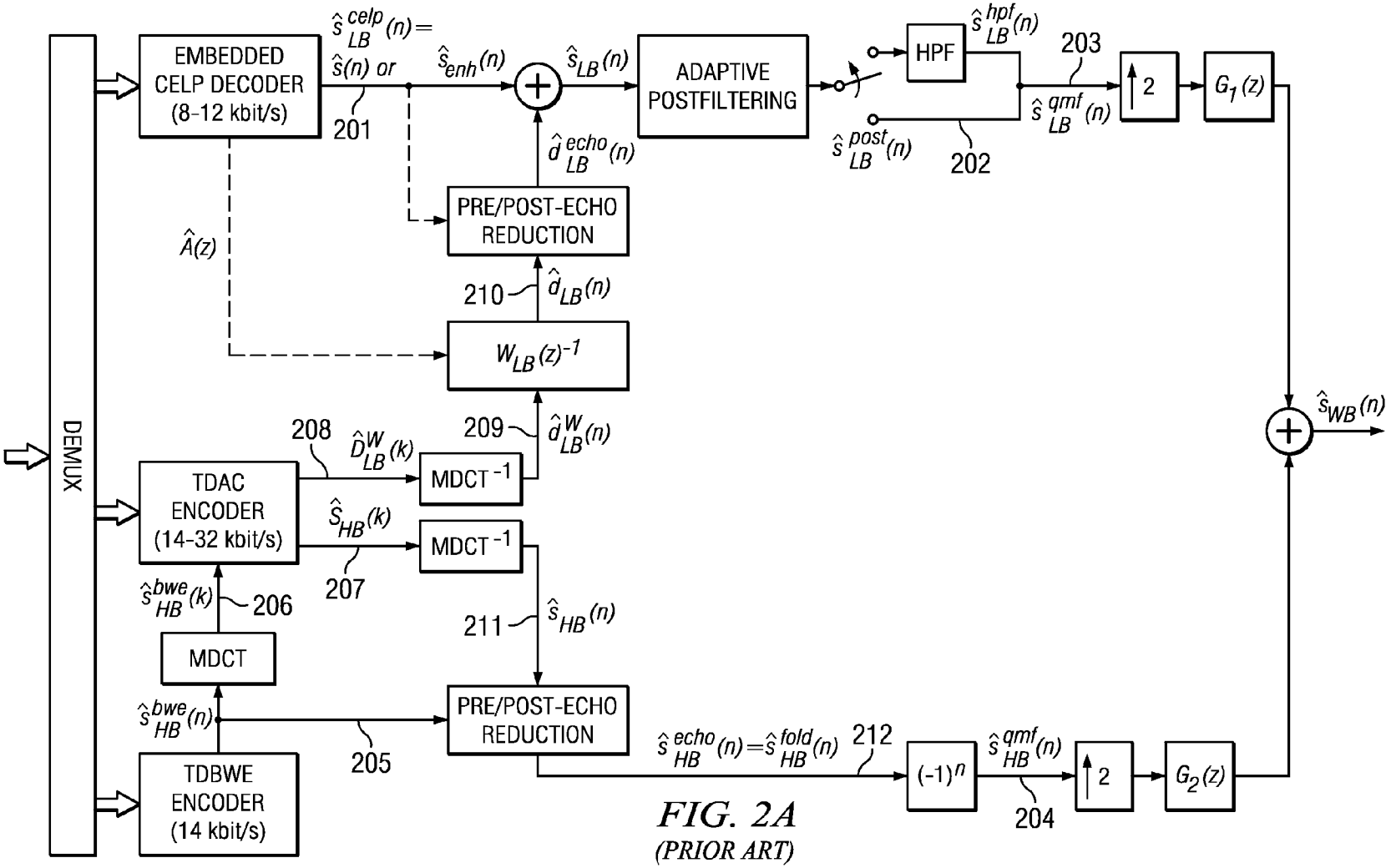
FIG. 2A (PRIOR ART)
FIG. 2*a* illustrates high-level block diagram of a prior-art G.729.1 decoder.
Figure 2B:
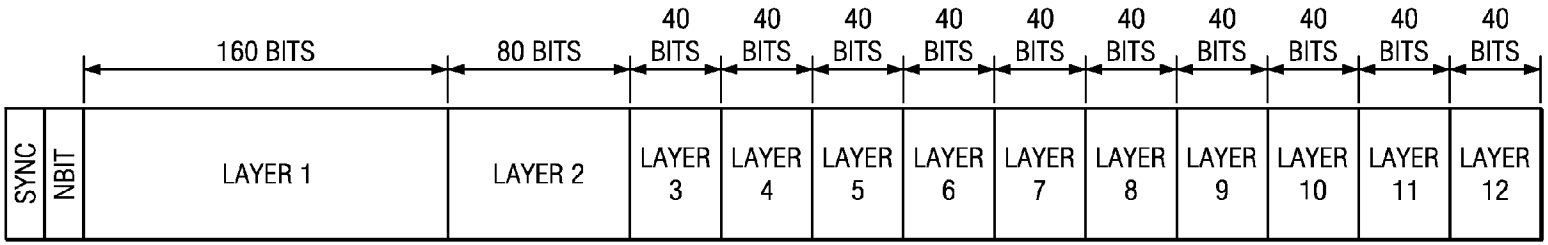
FIG. 2B (PRIOR ART)
FIG. 2*b* illustrates the bitstream format of G.729EV.
Figure 3:
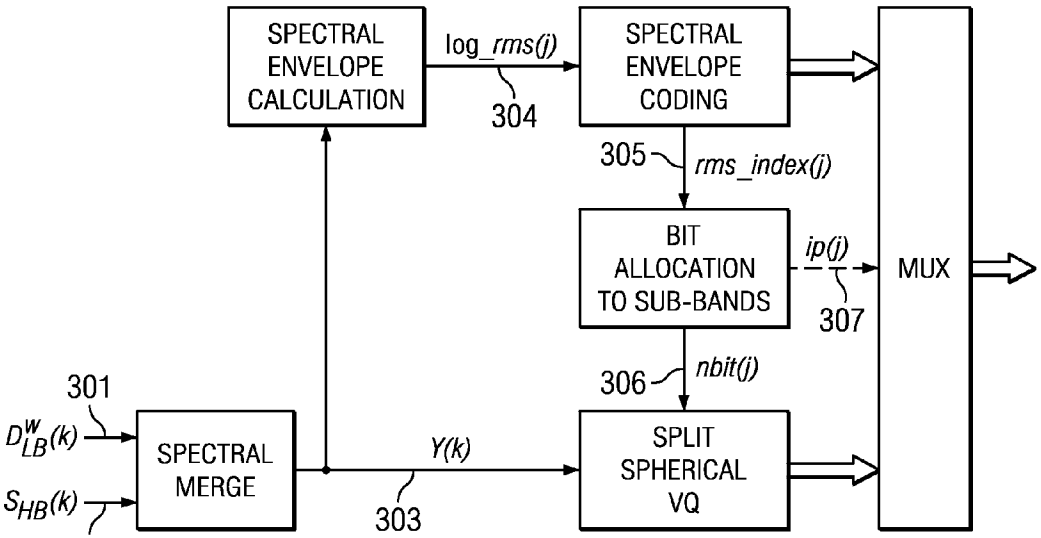
FIG. 3 (PRIOR ART)
FIG. 3 illustrates high-level block diagram of a prior art G.729.1 TDAC encoder.
Figure 4:
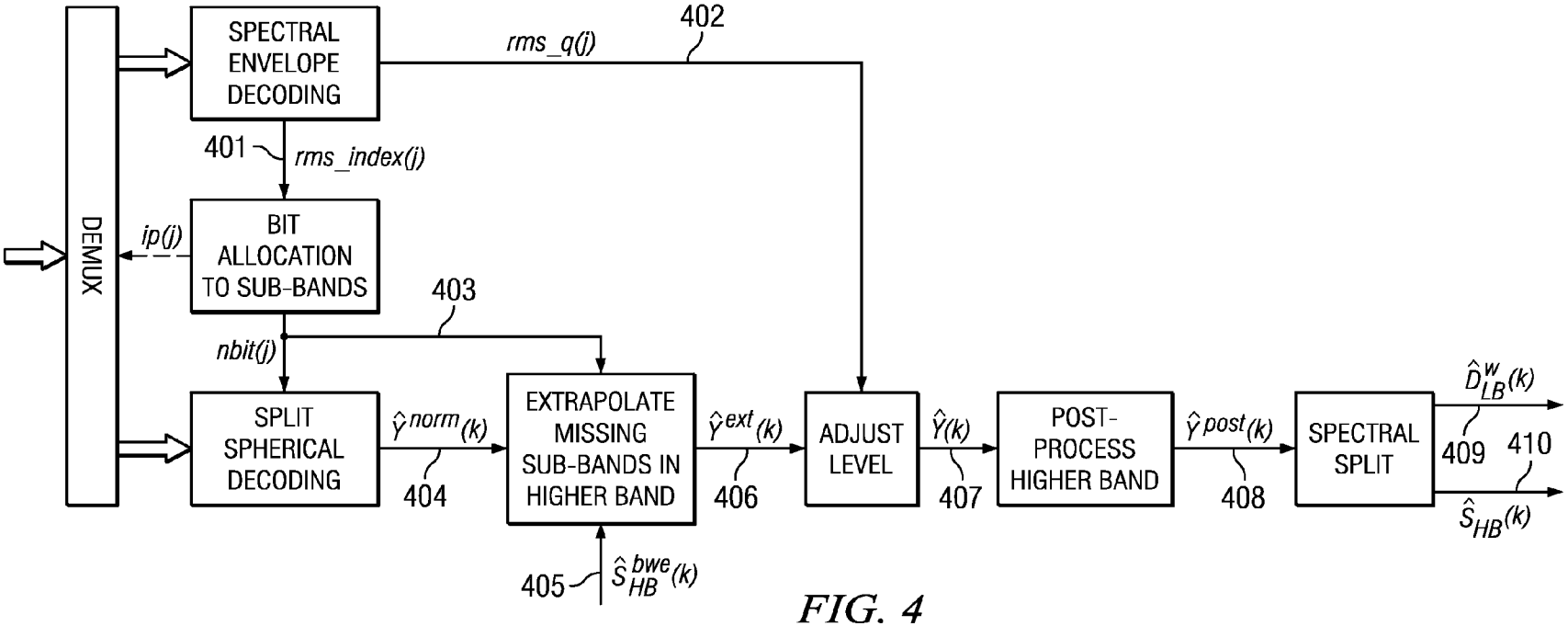
FIG. 4 (PRIOR ART)
FIG. 4 illustrates a block diagram of a prior-art G.729.1 TDAC decoder.

Corresponding numerals and symbols in different figures generally refer to corresponding parts unless otherwise indicated. The figures are drawn to clearly illustrate the relevant aspects of embodiments of the present invention and are not necessarily drawn to scale. To more clearly illustrate certain embodiments, a letter indicating variations of the same structure, material, or process step may follow a figure number.

DETAILED DESCRIPTION OF ILLUSTRATIVE EMBODIMENTS

The making and using of embodiments are discussed in detail below. It should be appreciated, however, that the present invention provides many applicable inventive concepts that may be embodied in a wide variety of specific contexts. The specific embodiments discussed are merely illustrative of specific ways to make and use the invention, and do not limit the scope of the invention.

The present invention will be described with respect to embodiments in a specific context, namely a system and method for performing audio coding for telecommunication systems. Embodiments of this invention may also be applied to systems and methods that utilize speech and audio transform coding.

Coded-Excited Linear Prediction (CELP) is a very popular technology that is mainly used to encode speech signal by using specific human voice characteristics or a human vocal voice production model. Conventional CELP codecs work well for speech signals; but they are often not satisfactory for music signals. Recent development of new ITU-T standards for scalable codecs, such as scalable super-wideband codecs, takes existing ITU-T standards, such as ITU G.729.1 and G.718, as core layers and extends wideband coding to super-wideband coding. If ITU G.729.1 is in the core layer, the narrowband portion is first coded with CELP technology, then the ITU G.729.1 higher layers will add one MDCT enhancement layer to further improve the CELP-coded narrowband output in a scalable way. When the bit rates for the new scalable super-wideband codecs become very high, the quality requirement also becomes very high, and the first MDCT enhancement layer added to the CELP-coded narrowband in the G.729.1 may not be good enough to provide acceptable audio quality.

In embodiments of the present invention, a second MDCT enhancement layer is added to the first MDCT enhancement layer. In other words, instead of increasing the bit rate of the first MDCT enhancement layer, an independent second MDCT enhancement layer is added. In order to have the coding efficiency, the second MDCT enhancement layer should be added at right time and right subbands.

At the highest bit rate 32 kbps of ITU-T G.729.1, some subbands in the narrowband area of the first MDCT enhancement layer are still not coded or missed due to lack of bits. The highest bit rate of a recently developed scalable super-wideband codec, which uses ITU-T G.729.1 as the wideband core codec, can reach 64 kbps. In embodiments of the present invention, not only the coding of the missing subbands of the first MDCT enhancement layer can be compensated at high bit rates, but also a second independent MDCT enhancement layer can be added as well.

In embodiments of the present invention, CELP is used in the inner core of a scalable codec which includes a first MDCT enhancement layer to code the CELP output distortion, and an independent second MDCT enhancement layer is further used to achieve high quality at high bit rates. In the second MDCT enhancement layer, not only is a new coding of fine spectrum coefficients of a second coding error added, but also a new spectral envelope coding of the second coding error is added. In some embodiments, sometimes an independent second MDCT enhancement layer is used even though missing subbands of the first MDCT enhancement layer are added first. Embodiment approaches are different from conventional approaches where only the quantization of fine spectrum coefficients is improved by using additional bits, while keeping the same spectral envelope coding for higher enhancement layers. For example, in G.729.1 from Layer 5 to Layer 12, only the VQ coding codebook size of fine spectrum coefficients is increased while keeping the same spectral envelope coding as the lower layers. Embodiment approaches are also different from approaches such as, in some embodiments, if the second MDCT enhancement layer is not always added or bit allocation for the second MDCT enhancement layer is not fixed, selective detection is used to determine which signal frame and spectrum subbands comprise the second MDCT enhancement layer to efficiently use available bits.

Embodiments of the present invention also provide a few possible ways to make the selective detection. In particular, the invention can be advantageously used when ITU-T G.729.1 or G.718 CELP codec is in the core layer for a scalable super-wideband codec.

In embodiments of the present invention, adding a second independent MDCT enhancement layer in the scalable super-wideband codec, which uses ITU-T G.729.1 or G.718 as the core codec, will not influence the interoperability and bit-exactness of the core codec with the existing standards.

Figure 5:
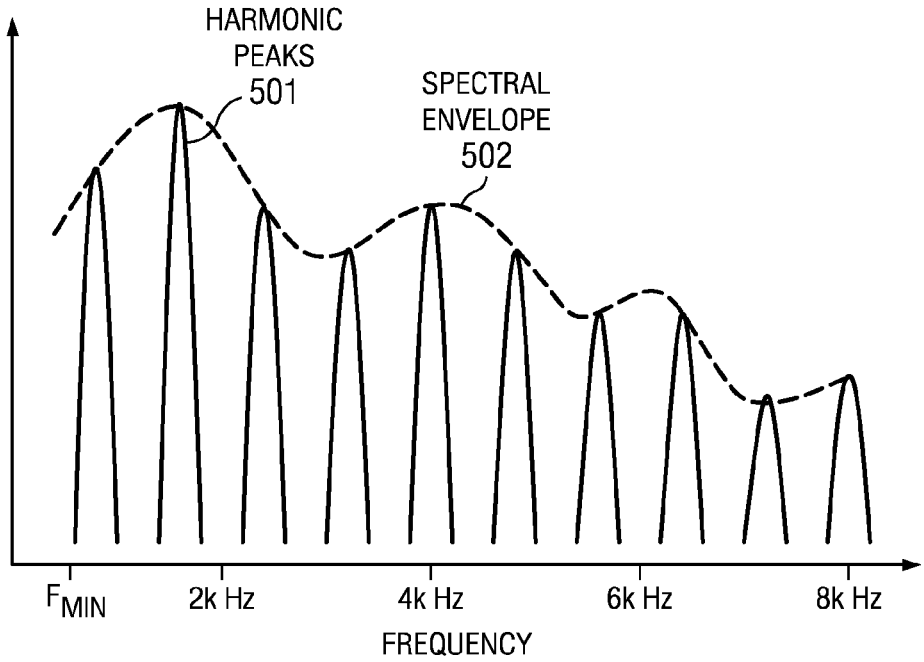
FIG. 5 illustrates an example of a regular wideband spectrum.
Figure 6:
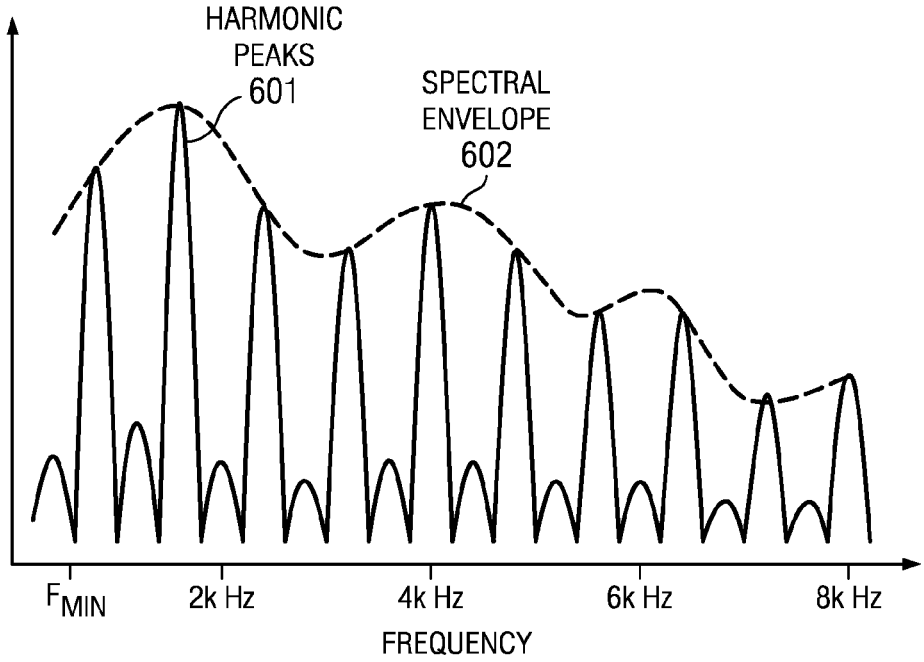
FIG. 6 illustrates an example of a regular wideband spectrum after pitch-postfiltering with doubling pitch lag.
Figure 7:
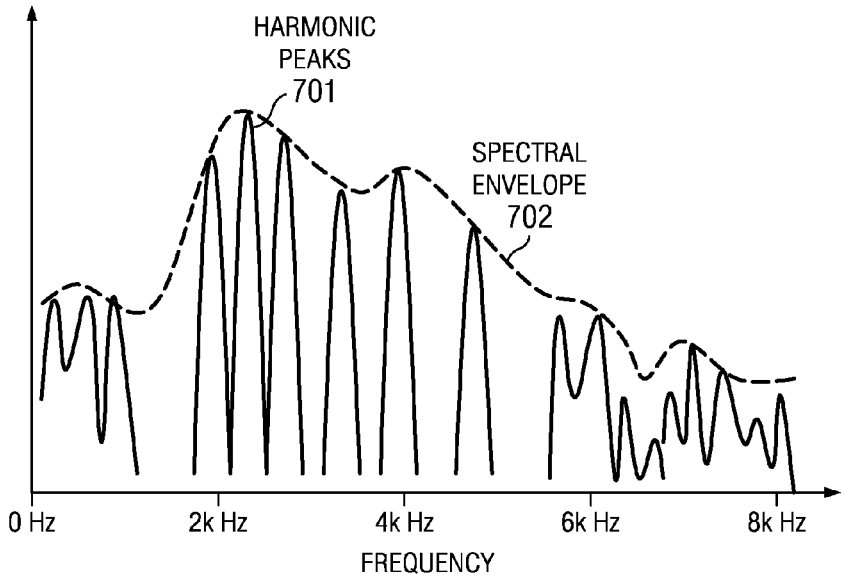
FIG. 7 illustrates an example of an irregular harmonic wideband spectrum.

As mentioned hereinabove, the CELP model works well for speech signals, but the CELP model may become problematic for music signals due to various reasons. For example, CELP uses pulse-like excitation, however, an ideal excitation for most music signals is not pulse-like. Open-loop pitch lag in the G.729.1 CELP core layer was designed in the range from 20 to 143, which adapts most human voice, while regular music harmonics (as shown in FIG. 5) or singing voice signals could require a pitch lag much smaller than P_MIN=20. In FIG. 5, trace 501 represents harmonic peaks and trace 502 represents a spectral envelope. If the real pitch lag is smaller than the minimum pitch lag limitation defined in the CELP, the transmitted pitch lag could be double or triple of the real pitch lag, resulting in a distorted spectrum as shown in FIG. 6, where trace 601 represents harmonic peaks and trace 602 represents a spectral envelope. Music signals often contain irregular harmonics as shown in FIG. 7, where trace 701 represents harmonic peaks and trace 702 represents a spectral envelope. These irregular harmonics can cause inefficient long-term prediction (LTP) in the CELP. In order to mainly compensate for the quality of music signals, the ITU-T standard G.729.1 added an MDCT enhancement layer to the CELP-coded narrowband as described in the background hereinabove.

The MDCT coding model can code slowly changing harmonic signals well. However, due to limited bit rates in the G.729.1, even the highest rate (32 kbps) in the G.729.1 does not deliver enough quality in narrowband for most music signals because the added MDCT enhancement layer is subject to limited bit rate budget. If this added layer is called the first MDCT enhancement layer, a second MDCT enhancement layer added to the first layer is used to further improve the quality when the coding bit rate goes up while the CELP is not good enough.

In the recent development of several ITU-T new standards, existing CELP based standards (such as G.729.1) are used to be in the core layers of new scalable audio codecs. The new standards must meet the condition that at least the core layer encoder can not be changed in order to maintain the compatibility with the existing standards. Furthermore, bit-exactness for core layers of standard codecs is desired. Although the new MDCT layers added by the new scalable super-wideband codecs at high bit rates mainly focus on coding the subbands that are not coded by the core layers, such as super-wideband area (8 k-14 kHz) and/or zero bit allocation area where the spectrum is generated without spending any bit in the core, in embodiments of the present invention, a second MDCT enhancement layer is added at high bit rates for some music signals to achieve the quality goal.

As described in the background, the first MDCT enhancement layer is used to code the first coding error, which represents the distortion of CELP output; the first coding error is the weighted spectrum difference between the original reference input and the CELP decoded output. The first MDCT enhancement layer $\hat{D}_{LB}^{w}(k)$ includes spectral envelope coding of the first coding error and VQ coding of the fine spectrum coefficients of the first coding error. It may seem that the further reduction of the weighted spectrum error can be simply done by adding more VQ coding of the fine spectrum coefficients and keeping the same spectral envelope coding, as the spectral envelope coding is already available. A similar idea has been applied to G.729.1 high band MDCT coding where only the VQ size is increased from Layer 5 to Layer 12 and the envelope coding is kept the same. However, because the CELP error is unstable, after the first enhancement layer coding, the remaining error becomes even more unstable. Embodiments of the present invention, therefore, introduce an independent second MDCT enhancement layer coding, where a new error spectral envelope coding is also added if the bit budget is available.

Using the G.729.1 as example of the core layer, the independent second MDCT enhancement layer is defined to code the weighted error's error (or simply called the second coding error):

$$dd_{LB}^{w}(n)=d_{LB}^{w}(n)-\hat{d}_{LB}^{w}(n). \tag{11}$$

In the frequency domain, the weighted error's error is:

$$DD_{LB}(k)=D_{LB}^{w}(k)-\hat{D}_{LB}^{w}(k). \tag{12}$$

If the error's error is expressed in non-weighted domain, they can be noted as, $$dd_{LB}(n)=d_{LB}(n)-\hat{d}_{LB}(n). \tag{13}$$

$$DD_{LB}(k)=D_{LB}(k)-\hat{D}_{LB}(k). \tag{14}$$

Similarly, the coding error of the core layer for the high band can be defined as, $$d_{HB}(n)=s_{HB}(n)-\hat{s}_{HB}(n) \tag{15}$$

$$D_{HB}(k)=S_{HB}(k)-\hat{S}_{HB}(k) \tag{16}$$

Encoding the error's error in the narrowband reveals that at specific subbands, the first MDCT enhancement layer already coded the CELP coding error, but the coding quality is still not good enough due to limited bit rate in the core codec. If the second enhancement layer is always added or the bit allocation for the second enhancement layer is fixed, no decision is needed to determine when and where the second MDCT enhancement layer is added. Otherwise, a decision of needing the second independent MDCT enhancement layer is made. In other words, if it is not always needed to add the second MDCT enhancement layer, selective detection ways can be introduced to increase the coding efficiency. Basically, what is determined is what time frame and which spectrum subbands need the second MDCT enhancement layer.

Taking the example of ITU-T G.729.1 used as the core codec of a scalable extension codec, the following parameters may help to determine when and where the second MDCT enhancement layer is needed: relative second coding error energy, relative weighted second coding error energy, second coding error energy relative to other bands, and weighted second coding error energy relative to other bands.

Relative Second Error Energy in Narrowband

The normalized relative second energy can be defined as:

$$RE1=\frac{\sum_n \|dd_{LB}(n)\|^2}{\sum_n \|s_{LB}(n)\|^2}, \tag{17}$$

which is a ratio between the second error energy and the original signal energy. Variants of this parameter can be defined, for example, as:

$$RE1=\frac{\sqrt{\sum_n \|dd_{LB}(n)\|^2}}{\sqrt{\sum_n \|s_{LB}(n)\|^2}}, \tag{18}$$

$$RE1=\frac{\sqrt{\sum_n \|dd_{LB}(n)\|^2}}{\sqrt{\sum_n \|s_{LB}(n)\|^2}}, \tag{19}$$

or, $$RE1=\frac{\sqrt{\sum_n \|dd_{LB}(n)\|^2}}{\sqrt{\sum_n \|d_{LB}(n)\|^2}}. \tag{20}$$

Relative Weighted Second Error Energy in Narrowband

The normalized weighted relative second energy can be defined as $$RE2=\frac{\sum_n \|dd^w_{LB}(n)\|^2}{\sum_n \|d^w_{LB}(n)\|^2}, \tag{21}$$

or, $$RE2=\frac{\sum_k \|DD^w_{LB}(k)\|^2}{\sum_k \|D^w_{LB}(k)\|^2}. \tag{22}$$

Other variants (as described above) of this parameter are also possible.

Second Error Energy Relative to Other Bands

The second error energy relative to the high bands can be defined as:

$$RE3=\frac{\sum_n \|dd_{LB}(n)\|^2}{\sum_n \|s_{HB}(n)\|^2}, \tag{23}$$

$$RE3=\frac{\sum_k \|DD_{LB}(k)\|^2}{\sum_k \|S_{HB}(k)\|^2}, \tag{24}$$

$$RE3=\frac{\sum_n \|dd_{LB}(n)\|^2}{\sum_n \|d_{HB}(n)\|^2}, \tag{25}$$

or, $$RE3=\frac{\sum_k \|DD_{LB}(k)\|^2}{\sum_k \|D_{HB}(k)\|^2}. \tag{26}$$

Other variants (as described above) of this parameter are also possible.

Weighted Second Error Energy Relative to Other Bands

The weighted second error energy relative to the high bands can be defined as $$RE4=\frac{\sum_n \|dd^w_{LB}(n)\|^2}{\sum_n \|s_{HB}(n)\|^2}, \tag{27}$$

$$RE4=\frac{\sum_k \|DD^w_{LB}(k)\|^2}{\sum_k \|S_{HB}(k)\|^2}, \tag{28}$$

$$RE4=\frac{\sum_n \|dd^w_{LB}(n)\|^2}{\sum_n \|d_{HB}(n)\|^2}, \tag{29}$$

$$RE4=\frac{\sum_k \|DD^w_{LB}(k)\|^2}{\sum_k \|D_{HB}(k)\|^2}, \tag{30}$$

-continued $$RE4 = \frac{\sum_n \|\hat{d}_{LB}^{w}(n)\|^2}{\sum_n \|\hat{s}_{HB}(n)\|^2}, \tag{31}$$

or, $$RE4 = \frac{\sum_k \|\hat{D}_{LB}^{w}(n)\|^2}{\sum_k \|\hat{S}_{HB}(n)\|^2}. \tag{32}$$

Actually, the numerator of (32) represents the weighted spectral envelope energy of the first weighted error signal. Other variants (as described above) of this parameter are also possible.

In embodiments, parameters can be expressed in time domain, frequency domain, weighted domain, non-weighted domain, linear domain, log domain, or perceptual domain. Parameters can be smoothed or unsmoothed, and they can be normalized or un-normalized. No matter what is the form of the parameters, the spirit is the same in that more bits are allocated in relatively high error areas or perceptually more important areas. The following parameters may further help to determine when and where the second MDCT enhancement layer is needed. Parameters include detecting pitch out of range, CELP pitch contribution or pitch gain, spectrum sharpness, spectral tilt, and music/speech distinguishing.

Detecting Pitch Out of Range

When real pitch lag for harmonic music signals or singing voice signals is smaller than the minimum lag limitation P_MIN defined in the CELP algorithm, the transmitted pitch lag could be double or triple of the real pitch lag. As a result, the spectrum of the synthesized signal with the transmitted lag, as shown in FIG. 6, has small peaks between real harmonic peaks, unlike the regular spectrum shown in FIG. 5. Usually, music harmonic signals are more stationary than speech signals. Pitch lag (or fundamental frequency) of normal speech signal keeps changing all the time, however, pitch lag (or fundamental frequency) of a music signal or singing voice signal changes relatively slowly for a long time duration. Once the case of double or multiple pitch lag happens, it could last quite long time for a music signal or a singing voice signal. Embodiments of the present invention detect if the pitch lag is out of the range defined in the CELP in the following manner. First, normalized or un-normalized correlations of the signals at distances of around the transmitted pitch lag, half (½) of the transmitted pitch lag, one third (⅓) of transmitted pitch lag, and even 1/m (m>3) of transmitted pitch lag, are estimated:

$$R(P) = \frac{\sum_n s(n)\cdot s(n-P)}{\sqrt{\sum_n \|s(n)\|^2 \cdot \sum_n \|s(n-P)\|^2}}. \tag{33}$$

Here, R(P) is a normalized pitch correlation with the transmitted pitch lag P. To avoid the square root in (33), the correlation is expressed as $R^2(P)$ and all negative R(P) values are set to zero. To reduce the complexity, the denominator of (33) can be omitted. Suppose $P_2$ is an integer selected around P/2, which maximizes the correlation $R(P_2)$; $P_3$ is an integer selected around P/3, which maximizes the correlation $R(P_3)$; $P_m$ is an integer selected around P/m, which maximizes the correlation $R(P_m)$. If $R(P_2)$ or $R(P_m)$ is large enough compared to R(P), and if this phenomena lasts certain time duration or happens for more than one coding frame, it is likely that the transmitted P is out of the range:

$$\text{if } (R(P_2) > C\cdot R(P)\ \&\ P_2 \approx \text{P_old}),\ P \text{ is out of defined range}$$

$$\vdots$$

$$\text{if } (R(P_m) > C\cdot R(P)\ \&\ P_m \approx \text{P_old}),\ P \text{ is out of defined range}$$

where P_old is pitch candidate from previous frame and supposed to be smaller than P_MIN. P_old is updated for next frame:

$$\text{initial P_old} = P;$$

$$\text{if } (R(P_2) > C\cdot R(P)\ \&\ P_2 < \text{P_MIN}),\ \text{P_old} = P_2;$$

$$\vdots$$

$$\text{if } (R(P_m) > C\cdot R(P)\ \&\ P_m < \text{P_MIN}),\ \text{P_old} = P_2;$$

C could be a weighting coefficient that is smaller than 1 but close to 1(for example, C=0.95). When P is out of the range, there is a high probability that the second MDCT enhancement layer is needed.

CELP Pitch Contribution or Pitch Gain

Spectral harmonics of voiced speech signals are regularly spaced. The Long-Term Prediction (LTP) function in CELP works well for regular harmonics as long as the pitch lag is within the defined range. However, music signals could contain irregular harmonics as shown in FIG. 7. In the case of irregular harmonics, the LTP function in CELP may not work well, resulting in poor music quality. When the CELP quality is poor, there is a good chance that the second MDCT enhancement layer is needed. If the pitch contribution or LTP gain is high enough, the CELP is considered successful and the second MDCT enhancement layer is not applied. Otherwise, the signal is checked to see if it contains harmonics. If the signal is harmonic and the pitch contribution is low, the second MDCT enhancement layer is applied in embodiments of the present invention. The CELP excitation consists of adaptive codebook component (pitch contribution component) and fixed codebook components (fixed codebook contributions). For example, the energy of the fixed codebook contributions for G.729.1 is noted as, $$E_c = \sum_{n=0}^{39} (\hat{g}_c \cdot c(n) + \hat{g}_{enh} \cdot c'(n))^2, \tag{34}$$

and the energy of the adaptive codebook contribution is $$E_p = \sum_{n=0}^{39} (\hat{g}_p \cdot v(n))^2. \tag{35}$$

One of the following relative voicing ratios or other ratios between $E_c$ and $E_p$ can measure the pitch contribution:

$$\xi_1 = \frac{E_p}{E_c}, \tag{36}$$

$$\xi_2 = \frac{E_p}{E_c + E_p}, \tag{37}$$

$$\xi_3 = \sqrt{\frac{E_p}{E_c}}, \tag{38}$$

$$\xi_4 = \sqrt{\frac{E_p}{E_c + E_p}}, \text{ or} \tag{39}$$

$$\xi_5 = \frac{\sqrt{E_p}}{\sqrt{E_c} + \sqrt{E_p}}. \tag{40}$$

Normalized pitch correlation in (33) can also be a measuring parameter.

Spectrum Sharpness

The spectrum sharpness parameter is mainly measured on the spectral subbands. It is defined as a ratio between the largest coefficient and the average coefficient magnitude in one of the subbands:

$$\text{Sharp} = \frac{\text{Max}\{|MDCT_i(k)|, k = 0, 1, 2, \ldots N_i - 1\}}{\frac{1}{N_i} \cdot \sum_k |MDCT_i(k)|}, \tag{41}$$

where $MDCT_i(k)$ is MDCT coefficients in the i-th frequency subband, $N_i$ is the number of MDCT coefficients of the i-th subband. In embodiments, usually the "sharpest" (largest) ratio Sharp among the subbands is used as the measuring parameter. Sharp can also be expressed as an average sharpness of the spectrum. Of course, the spectrum sharpness can be measured in DFT, FFT or MDCT frequency domain. If the spectrum is "sharp" enough, it denotes that harmonics exist. If the pitch contribution of CELP codec is low and the signal spectrum is "sharp", the second MDCT enhancement layer may be needed.

Spectral Tilt

This parameter can be measured in time domain or frequency domain. In the time domain, the tilt can be expressed as, $$Tilt1 = \frac{\sum_n s(n) \cdot s(n-1)}{\sum_n \|s(n)\|^2}. \tag{42}$$

where s(n) can be the original input signal or synthesized output signal. This tilt parameter can also be simply represented by the first reflection coefficient from LPC parameters.

If the tilt parameter is estimated in frequency domain, it may be expressed as, $$Tilt2 = \frac{E_{high_band}}{E_{low_band}}. \tag{43}$$

where $E_{high_band}$ represents high band energy, $E_{low_band}$ reflects low band energy. If the signal contains much more energy in low band than in high band while the CELP pitch contribution is very low, the second MDCT enhancement layer may be needed.

Music/Speech Distinguishing

Distinguishing between music and speech signals helps determine if the second MDCT enhancement layer is needed or not. Normally CELP technology works well for speech signals. If we know an input signal is not speech, the further checking may be desired. An embodiment method of distinguishing music and speech signals is measuring if the spectrum of the signal changes slowly or fast. Such a spectral envelope measurement can be expressed as, $$Diff_F_{env} = \sum_i \frac{|F_{env}(i) - F_{env,old}(i)|}{F_{env}(i) + F_{env,old}(i)}, \tag{44}$$

where $F_{enc}(i)$ represents a current spectral envelope, which could be in log domain, linear domain, quantized, unquantized, or even quantized index, and $F_{enc,old}(i)$ is the previous $F_{enc}(i)$. Variant measuring parameters can be expressed as:

$$Diff_F_{env} = \sum_i \frac{[F_{env}(i) - F_{env,old}(i)]^2}{[F_{env}(i) + F_{env,old}(i)]^2}, \tag{45}$$

$$Diff_F_{env} = \frac{\sum_i |F_{env}(i) - F_{env,old}(i)|}{\sum_i F_{env}(i) + F_{env,old}(i)}, \tag{46}$$

or, $$Diff_F_{env} = \frac{\sum_i [F_{env}(i) - F_{env,old}(i)]^2}{\sum_i [F_{env}(i) + F_{env,old}(i)]^2}. \tag{47}$$

When $Diff_F_{env}$ is small, it is slow signal. Otherwise, it is fast signal. If the signal is slow and it contains harmonics, the second MDCT enhancement layer may be needed.

All above parameters can be performed in a form called a running mean that takes some kind of average of recent parameter values. This can be accomplished by counting the number of the small parameter values or large parameter values.

In an embodiment of the present invention, a method of improving a scalable codec is used when a CELP codec is the inner core layer of scalable codec. An independent second MDCT enhancement layer is introduced to further code the second coding error after the first MDCT enhancement layer; The scalable codec has the first MDCT enhancement layer to code the first coding error. The independent second MDCT enhancement layer not only adds the new coding of fine spectrum coefficients of the second coding error, but it also codes a new spectral envelope of the second coding error.

In another embodiment of the present invention, a method of selectively adding the independent second MDCT enhancement layer is used according to a determination of whether or not the second MDCT enhancement layer is needed. The determination is based on one of the listed parameters and approaches described hereinabove, or a combination of the listed parameters and approaches.

Figure 8:
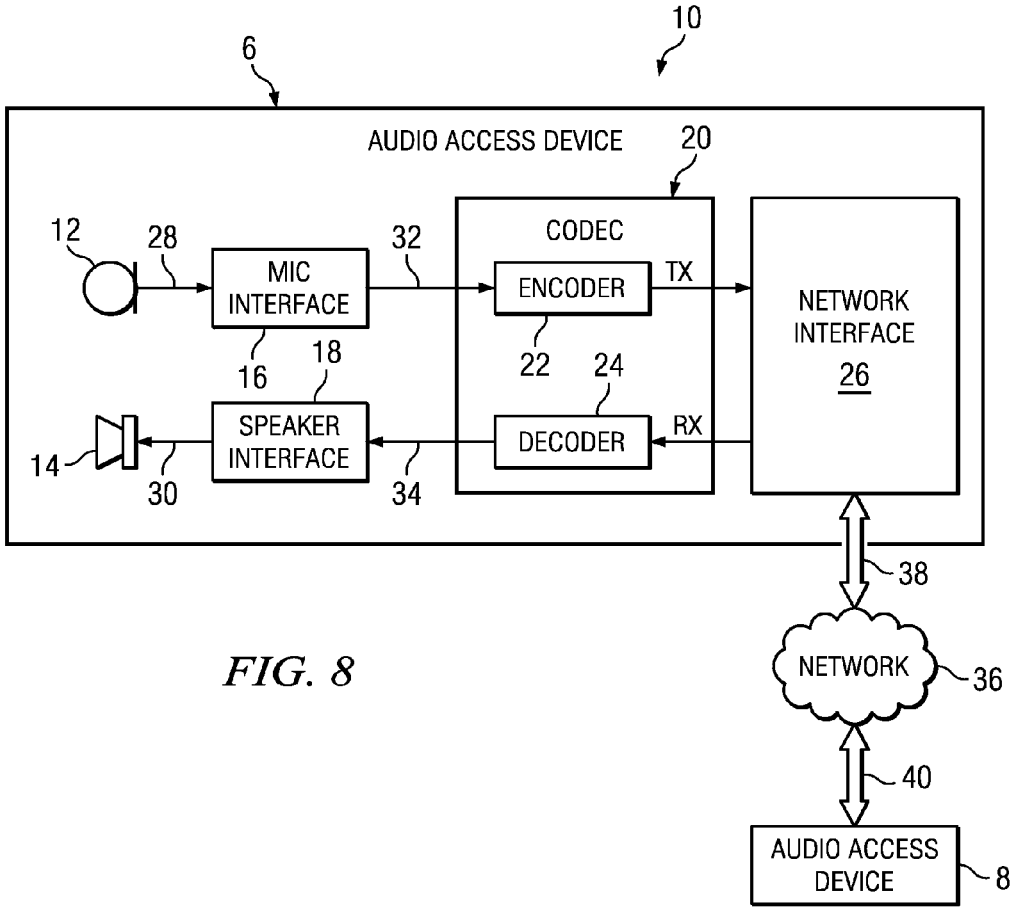
FIG. 8 illustrates a communication system according to an embodiment of the present invention.

FIG. 8 illustrates communication system 10 according to an embodiment of the present invention. Communication system 10 has audio access devices 6 and 8 coupled to network 36 via communication links 38 and 40. In one embodiment, audio access device 6 and 8 are voice over internet protocol (VOIP) devices and network 36 is a wide area network (WAN), public switched telephone network (PSTN) and/or the internet. Communication links 38 and 40 are wireline and/or wireless broadband connections. In an alternative embodiment, audio access devices 6 and 8 are cellular or mobile telephones, links 38 and 40 are wireless mobile telephone channels and network 36 represents a mobile telephone network.

Audio access device 6 uses microphone 12 to convert sound, such as music or a person's voice into analog audio input signal 28. Microphone interface 16 converts analog audio input signal 28 into digital audio signal 32 for input into encoder 22 of CODEC 20. Encoder 22 produces encoded audio signal TX for transmission to network 26 via network interface 26 according to embodiments of the present invention. Decoder 24 within CODEC 20 receives encoded audio signal RX from network 36 via network interface 26, and converts encoded audio signal RX into digital audio signal 34. Speaker interface 18 converts digital audio signal 34 into audio signal 30 suitable for driving loudspeaker 14.

In an embodiments of the present invention, where audio access device 6 is a VOIP device, some or all of the components within audio access device 6 are implemented within a handset. In some embodiments, however, Microphone 12 and loudspeaker 14 are separate units, and microphone interface 16, speaker interface 18, CODEC 20 and network interface 26 are implemented within a personal computer. CODEC 20 can be implemented in either software running on a computer or a dedicated processor, or by dedicated hardware, for example, on an application specific integrated circuit (ASIC). Microphone interface 16 is implemented by an analog-to-digital (A/D) converter, as well as other interface circuitry located within the handset and/or within the computer. Likewise, speaker interface 18 is implemented by a digital-to-analog converter and other interface circuitry located within the handset and/or within the computer. In further embodiments, audio access device 6 can be implemented and partitioned in other ways known in the art.

In embodiments of the present invention where audio access device 6 is a cellular or mobile telephone, the elements within audio access device 6 are implemented within a cellular handset. CODEC 20 is implemented by software running on a processor within the handset or by dedicated hardware. In further embodiments of the present invention, audio access device may be implemented in other devices such as peer-to-peer wireline and wireless digital communication systems, such as intercoms, and radio handsets. In applications such as consumer audio devices, audio access device may contain a CODEC with only encoder 22 or decoder 24, for example, in a digital microphone system or music playback device. In other embodiments of the present invention, CODEC 20 can be used without microphone 12 and speaker 14, for example, in cellular base stations that access the PTSN.

The above description contains specific information pertaining to the adding of the independent second MDCT enhancement layer for a scalable codec with CELP in the inner core. However, one skilled in the art will recognize that the present invention may be practiced in conjunction with various encoding/decoding algorithms different from those specifically discussed in the present application. Moreover, some of the specific details, which are within the knowledge of a person of ordinary skill in the art, are not discussed to avoid obscuring the present invention.

The drawings in the present application and their accompanying detailed description are directed to merely example embodiments of the invention. To maintain brevity, other embodiments of the invention that use the principles of the present invention are not specifically described in the present application and are not specifically illustrated by the present drawings.

It will also be readily understood by those skilled in the art that materials and methods may be varied while remaining within the scope of the present invention. It is also appreciated that the present invention provides many applicable inventive concepts other than the specific contexts used to illustrate embodiments. Accordingly, the appended claims are intended to include within their scope such processes, machines, manufacture, compositions of matter, means, methods, or steps.

What is claimed is:

1. A method of transmitting an input audio signal with a scalable codec by an audio access device comprising a processor, the method comprising:

encoding, by the processor, a low frequency band signal having an inner core layer coding;

encoding, by the processor, a first coding error of the inner core layer coding having a first enhancement layer on the low frequency band of the low frequency band signal;

encoding, by the processor, a second coding error of the first enhancement layer by using a second enhancement layer on the low frequency band of the low frequency band signal after the first enhancement layer, encoding the second coding error comprising coding fine spectrum coefficients of the second coding error to produce coded fine spectrum coefficients, and coding a spectral envelope of the second coding error to produce a coded spectral envelope; and transmitting the coded fine spectrum coefficients and the coded spectral envelope.

2. The method of claim 1, wherein the scalable codec comprises an inner core layer of code-excited linear prediction (CELP) codec.

3. The method of claim 2, wherein:

the first coding error represents a distortion of an output of the CELP codec; and the first coding error is a weighted difference between an original reference input and a decoded output of the CELP codec.

4. The method of claim 1, wherein:

the first enhancement layer comprises a first modified discrete cosine transform (MDCT) enhancement layer; and the second enhancement layer comprises a second MDCT enhancement layer.

5. The method of claim 4, further comprising compensating missing subbands of the first MDCT enhancement layer before encoding the second coding error using the second MDCT enhancement layer.

6. The method of claim 4, wherein the second coding error is determined by the frequency domain expression:

$$DD_{LB}^{w}(k)=D_{LB}^{w}(k)-\hat{D}_{LB}^{w}(k);$$

$\hat{D}_{LB}^{w}(k)$ comprises a quantized output of the first MDCT enhancement layer in a weighted domain; and $D_{LB}^{w}(k)$ comprises unquantized MDCT coefficients of the first coding error.

7. The method of claim 1, wherein coding the spectral envelope of the second coding error comprises coding subband energies of a second coding error spectrum in a log domain, a linear domain or a weighted domain.

8. The method of claim 1, wherein coding fine spectrum coefficients of the second coding error comprises:

performing additional spectral vector quantization (VQ) coding of the second coding error after normalizing spectral energy based on the coded spectral envelope of the second coding error.

9. The method of claim 1, further comprising:

receiving the coded fine spectrum coefficients and the coded spectral envelope of the second enhancement layer at a decoder; and forming an output audio signal based on the coded fine spectrum coefficients and the coded spectral envelope.

10. The method of claim 9, further comprising driving a loudspeaker with the output audio signal.

11. The method of claim 1, wherein transmitting comprises transmitting over a voice over internet protocol (VOIP) network.

12. The method of claim 1, wherein transmitting comprises transmitting over a cellular telephone network.

13. A method of transmitting an input audio signal with a scalable codec by an audio access device comprising a processor, the method comprising:

encoding, by the processor, a low frequency band signal having an inner core layer coding;

encoding, by the processor, a first coding error of the inner core layer coding having a first modified discrete cosine transform (MDCT) enhancement layer on the low frequency band of the low frequency band signal;

determining if a second MDCT enhancement layer is needed on the low frequency band of the low frequency band signal; and if the second MDCT enhancement layer is needed based on the determining, encoding, by the processor, a second coding error by using the second MDCT enhancement layer after the first modified MCDT enhancement layer.

14. The method of claim 13, wherein determining if the second MDCT enhancement layer is needed comprises analyzing relative energies in different spectral subbands of the first coding error in a log domain, a linear domain or a perceptual domain.

15. The method of claim 13, wherein determining if the second MDCT enhancement layer is needed comprises analyzing relative energies in different spectral subbands of the second coding error in a log domain, a linear domain or a perceptual domain.

16. The method of claim 13, wherein:

the inner core layer coding is a code-excited linear prediction (CELP) codec; and determining if the second MDCT enhancement layer is needed comprises checking if a transmitted pitch lag is different from a real pitch lag while the real pitch lag is out of range limitations defined in the CELP codec.

17. The method of claim 13, wherein determining if the second MDCT enhancement layer is needed comprises analyzing a pitch gain, a pitch correlation, a voicing ratio representing signal periodicity, a spectral sharpness measuring based on a ratio between an average energy level and a maximum energy level, a spectral tilt measurement in a time domain or a frequency domain, and/or a spectral envelope stability measurement on a relative spectrum energy differences over time.

18. The method of claim 17, wherein the spectral envelope stability measurement is expressed as:

$$Diff_F_{env} = \sum_i \frac{|F_{env}(i) - F_{env,old}(i)|}{F_{env}(i) + F_{env,old}(i)}$$

where $F_{enc}(i)$ comprises a current spectral envelope, which can be in a log domain, in a linear domain, quantized, unquantized, or a quantized index, and $F_{enc,old}(i)$ comprises a previous $F_{enc}(i)$.

19. A system for transmitting an input audio signal with a scalable codec, the system comprising:

a transmitter comprising an audio coder, the audio coder comprising an inner core layer coding with a code-excited linear prediction (CELP) codec configured to encode a low frequency band signal, a first modified discrete cosine transform (MDCT) enhancement layer configured to encode a first coding error of the inner core layer coding of CELP on the low frequency band of the low frequency band signal, and a second MDCT enhancement layer configured to encode a second coding error of the first MDCT enhancement layer on the low frequency band of the low frequency band signal, encode fine spectrum coefficients of the second coding error, and encode a spectral envelope of the second coding error.

20. The system of claim 19, wherein the audio coder is configured to determine if the second MDCT enhancement layer is needed based on analyzing the input audio signal.

21. The system of claim 19, wherein the system is configured to operate over a voice over internet protocol (VOIP) system.

22. The system of claim 19, wherein the system is configured to operate over a cellular telephone network.

* * * * *